US011542887B2

(12) United States Patent
Toth

(10) Patent No.: US 11,542,887 B2
(45) Date of Patent: Jan. 3, 2023

(54) CYLINDER HEAD FOR AN INTERNAL COMBUSTION ENGINE

(71) Applicant: Bayerische Motoren Werke Aktiengesellschaft, Munich (DE)

(72) Inventor: Istvan Toth, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 515 days.

(21) Appl. No.: 16/278,895

(22) Filed: Feb. 19, 2019

(65) Prior Publication Data

US 2019/0178200 A1 Jun. 13, 2019

Related U.S. Application Data

(63) Continuation of application No. PCT/EP2017/069989, filed on Aug. 8, 2017.

(30) Foreign Application Priority Data

Aug. 30, 2016 (DE) ..... 10 2016 216 360.4

(51) Int. Cl.
*F02F 1/40* (2006.01)
*F02F 1/24* (2006.01)

(52) U.S. Cl.
CPC ..... *F02F 1/40* (2013.01); *F02F 1/242* (2013.01)

(58) Field of Classification Search
CPC ..... F02F 1/40; F02F 1/38; F02F 1/36; F02F 1/26; F02F 1/242; F02F 2001/244; F02F 1/14; F02F 1/10; F02F 1/02
See application file for complete search history.

(56) References Cited

U.S. PATENT DOCUMENTS

2006/0011151 A1* 1/2006 Huter ..... F01P 3/02 123/41.29
2006/0054112 A1* 3/2006 Paul ..... F02F 1/40 123/41.32

(Continued)

FOREIGN PATENT DOCUMENTS

AT 501 008 A2 5/2006
AT 501 229 A1 7/2006

(Continued)

OTHER PUBLICATIONS

Chinese-language Office Action issued in Chinese Application No. 201780033191.3 dated May 7, 2020 with English translation (14 pages).

(Continued)

*Primary Examiner* — Lindsay M Low
*Assistant Examiner* — Ruben Picon-Feliciano
(74) *Attorney, Agent, or Firm* — Crowell & Moring LLP

(57) ABSTRACT

A cylinder head for an internal combustion engine with at least one cylinder has a cooling duct system which has a coolant inlet side and a coolant outlet side, a combustion chamber section, two coolant-inlet-side gas ducts, two coolant-outlet-side gas ducts and two adjacent component openings, such as a spark plug opening and an injection nozzle opening. The cylinder head has an annular wall section provided between the component openings, on the one hand, and the gas ducts, on the other hand. The cooling duct system has a web cooling duct which runs into the annular wall section, extends between the coolant-inlet-side gas ducts and has an upper wall. The upper wall has a guiding surface which is directed obliquely downwards in the region of the annular wall section in order to deflect coolant in the direction of the combustion chamber section.

16 Claims, 5 Drawing Sheets

(56) References Cited

U.S. PATENT DOCUMENTS

| | | | | |
|---|---|---|---|---|
| 2010/0089344 | A1* | 4/2010 | Knollmayr ..... | F02F 1/40 123/41.82 R |
| 2011/0226198 | A1 | 9/2011 | Maruyama et al. | |

FOREIGN PATENT DOCUMENTS

| | | | |
|---|---|---|---|
| CN | 102192040 | A | 9/2011 |
| CN | 104295394 | A | 1/2015 |
| CN | 205243663 | U | 5/2016 |
| DE | 100 46 582 | A1 | 4/2002 |
| DE | 100 48 582 | A1 | 4/2002 |
| DE | 102 37 664 | A1 | 2/2004 |
| DE | 10 2004 015 134 | A1 | 10/2005 |
| DE | 10 2004 015 134 | A1 | 10/2005 |
| DE | 10 2007 062 347 | A1 | 6/2009 |
| DE | 10 2008 047 185 | A1 | 4/2010 |
| DE | 10 2009 044 158 | A1 | 4/2010 |
| DE | 10 2010 041 105 | A1 | 3/2012 |
| DE | 10 2012 102 905 | A1 | 7/2013 |
| FR | 3 026 788 | A3 | 4/2016 |
| JP | 2009-62836 | A | 3/2009 |
| WO | WO 2004/074652 | A1 | 9/2004 |
| WO | WO 2013/047239 | A1 | 4/2013 |

OTHER PUBLICATIONS

International Search Report (PCT/ISA/210) issued in PCT Application No. PCT/EP2017/069989 dated Nov. 8, 2017 with English translation (seven (7) pages).

German-language Written Opinion (PCT/ISA/237) issued in PCT Application No. PCT/EP2017/069989 dated Nov. 8, 2017 (five (5) pages).

German-language Search Report issued in counterpart German Application No. 10 2016 216 360.4 dated Apr. 10, 2017 with partial English translation (13 pages).

German-language Examination Report dated Jul. 8, 2022 in German Patent Application No. DE 10 2016 216 360.4 (10 pages).

* cited by examiner

CYLINDER HEAD FOR AN INTERNAL COMBUSTION ENGINE

CROSS REFERENCE TO RELATED APPLICATIONS

This application is a continuation of PCT International Application No. PCT/EP2017/069989, filed Aug. 8, 2017, which claims priority under 35 U.S.C. § 119 from German Patent Application No. 10 2016 216 360.4, filed Aug. 30, 2016, the entire disclosures of which are herein expressly incorporated by reference.

BACKGROUND AND SUMMARY OF THE INVENTION

The invention relates to a cylinder head for an internal combustion engine, having a cooling duct system.

A cylinder head together with a cylinder block, on which the cylinder head is fastened, defines the combustion chamber of an internal combustion engine. Cooling ducts of a cooling duct system are formed both in the cylinder block and in the cylinder head and can transport away the waste heat arising during the combustion. Furthermore, the cylinder head has ducts and openings which lead into the combustion chamber. A fuel injection nozzle and a spark plug, for example, can project through the openings into the combustion chamber, and combustion gases can be supplied to the combustion chamber or removed from the combustion chamber through the ducts.

Accordingly, the cooling ducts in the cylinder head have to be guided around the gas ducts and around the other openings, thus resulting in complex geometries which are difficult to produce. A particular problem here is the cooling of the "web", i.e. of the region of the upper deck of the combustion chamber section that surrounds the spark plug opening and/or injection nozzle opening. In particular in the case of cylinder heads having four valves per cylinder, the region of the web is virtually completely surrounded by the gas ducts, and therefore this region can be difficult to cool with cooling ducts.

On account of this, only a low transport of heat away from the web occurs in the case of customary cylinder heads, and therefore high temperatures occur there during operation and may reduce the service life of the cylinder and therefore of the entire engine.

It is therefore an object of the invention to provide a cylinder head which permits improved cooling of the web.

The object is achieved by a cylinder head for an internal combustion engine having at least one cylinder, having a cooling duct system which has a coolant-inlet side and a coolant-outlet side, a combustion chamber section, two coolant-inlet-side gas ducts, two coolant-outlet-side gas ducts and two adjacent component openings, such as a spark plug opening and an injection nozzle opening, wherein the coolant-inlet-side gas ducts, the coolant-outlet-side gas ducts and the component openings all lead into the combustion chamber section. The cylinder head has an annular wall section which is provided between the component openings, on the one hand, and the gas ducts, on the other hand, wherein the cooling duct system has a web cooling duct which runs into the annular wall section, extends between the coolant-inlet-side gas ducts and has an upper wall. The upper wall has a guiding surface which is directed obliquely downward in the region of the annular wall section, in order to deflect coolant in the direction of the combustion chamber section. Here, "up" is understood as meaning that side of the cylinder head which faces away from the combustion chamber section. Accordingly, the direction "down" runs toward that side of the cylinder head at which the combustion chamber section is provided.

The coolant flows obliquely upward in the region of the coolant-inlet-side gas ducts and is then deflected downward in the direction of the web by the guiding surface which is directed obliquely downward. The coolant thereby flows directly toward the web, as a result of which efficient cooling of the web is achieved. The heat transmitted to the web by the combustion operation can therefore be efficiently removed, and therefore the service life of the engine is increased.

In this case, the coolant-inlet-side gas ducts can be the outlet ducts of the cylinder and the coolant-outlet-side gas ducts can be the inlet ducts of the cylinder. For example, the coolant-inlet-side component opening is the spark plug opening and the coolant-outlet-side component opening is the opening for the injection nozzle.

The cylinder head can be produced by casting. The cooling duct system is formed here by a core, wherein the core can be produced by 3D printing. The advantage of 3D printing is that any desired geometries, in particular those with undercut regions, can be produced.

For example, the web cooling duct rises between the coolant-inlet-side gas ducts, and therefore the contour of the upper side of the combustion chamber section can be followed in order to permit more efficient cooling.

Preferably, the upper wall rises between the coolant-inlet-side gas ducts, reaches its highest point on the coolant-inlet side before the center axis of the annular wall section and drops down toward the coolant-outlet side. This geometry ensures a particularly good flow toward the web. The highest point here means that point which is higher than the rest of the web cooling duct, at least from the center axis of the annular wall section on the coolant-inlet side.

In one refinement of the invention, the upper wall is partially wave-shaped with at least one wave crest, and therefore the coolant is deflected in a manner as free from turbulence as possible in the direction of the combustion chamber section. The downwardly directed guiding surface can be the dropping section of the wave crest here.

In a further embodiment of the invention, the web cooling duct has an extension which projects toward the combustion chamber section and is provided in the region of the annular wall section. It is possible by means of this extension to guide coolant in the region of the web closer to the combustion chamber section.

The extension is preferably provided in the region of the guiding surface and/or adjoining the region of the guiding surface on the coolant-outlet side, and therefore the coolant is deflected into the extension by the guiding surface.

For example, the upper wall of the web cooling duct has a wave trough in the region of the extension. This ensures that coolant sufficiently flows through the extension.

The extension can reach up to 9 mm or less to the combustion chamber section. The distance between the lower wall of the web cooling duct and the upper side of the combustion chamber section in the annular wall section is therefore at minimum only 9 mm or less, as a result of which particularly efficient cooling of the web is achieved.

In one variant embodiment, the cooling duct system has at least one outer cooling duct which runs to above one of the two coolant-inlet-side gas ducts and forms an upper coolant duct, as a result of which efficient cooling of the regions which are not cooled by the web cooling duct is made possible.

For example, in the half of the annular wall section which faces the outlet, in particular in the region of the coolant-outlet side of the two component openings, the web cooling duct leads into the upper cooling duct, and therefore the coolant is efficiently removed without relatively great pressure losses.

In particular, the upper wall, in particular the entire web cooling duct, rises again before the web cooling duct leads into the upper cooling duct, as a result of which a particularly advantageous flow is realized.

In one refinement of the invention, the web cooling duct is separated from the at least one outer cooling duct and the upper cooling duct on the coolant-inlet side of the center axis of the annular wall section. As a result, the coolant flow through the web cooling duct can be improved.

For example, on the coolant-inlet side of the two component openings, the web cooling duct branches into two branches which extend on different sides of the component openings, as a result of which a uniform cooling of the web around the component openings is made possible.

A guiding surface and/or an extension are preferably provided in each of the branches, and therefore optimum cooling of the web is achieved in each of the branches.

Two outer cooling ducts can be provided which flow together above the coolant-inlet-side gas ducts and form the upper cooling duct, as a result of which a coolant circuit through which the flow passes uniformly is realized.

The upper cooling duct preferably runs between the coolant-outlet-side gas ducts, and therefore the coolant-outlet-side gas ducts are also cooled.

Further features and advantages of the invention emerge from the description below and from the attached drawings, to which reference is made. In the drawings:

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
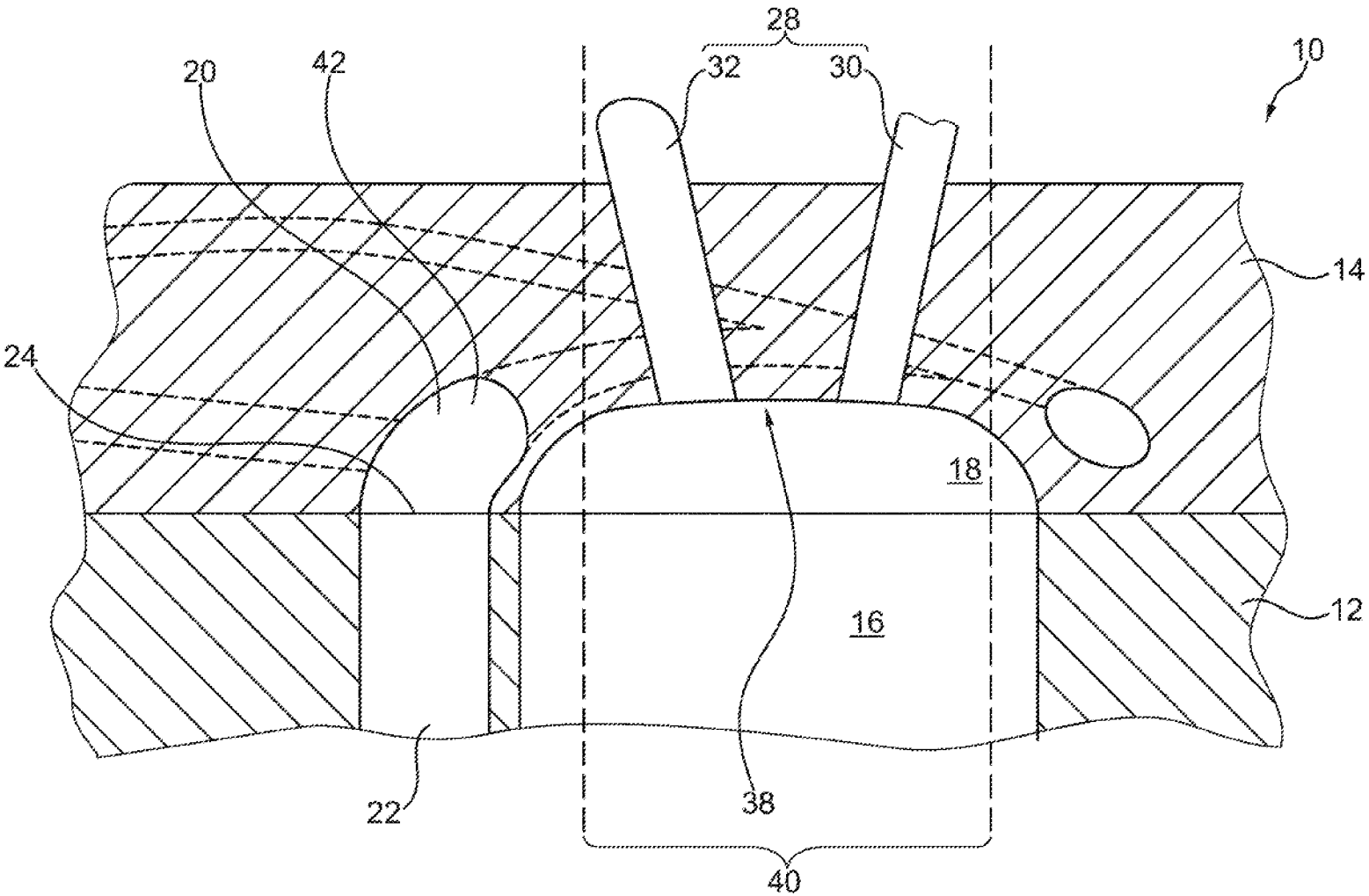
FIG. 1 shows a detail from a schematic sectional view of a combustion engine having a cylinder head according to an embodiment of the invention.

FIG. 1 illustrates an internal combustion engine 10 having a cylinder block 12 and a cylinder head 14, wherein this and all further illustrations are restricted to just one cylinder of the internal combustion engine 10. Of course, further cylinders can also adjoin the cylinder illustrated.

A combustion chamber 16 is provided in the internal combustion engine 10, wherein the cylinder head 14 forms a section of said combustion chamber 16, i.e. has a combustion chamber section 18.

The combustion chamber section 18 closes the upper end of the combustion chamber 16, i.e. that end of the combustion chamber 16 which serves as a compression chamber.

A plurality of directions with respect to the cylinder block 12 are specified here in the cylinder head 14, wherein "down" means in the direction of the cylinder block 12.

A cooling duct system 20, which is indicated in highly simplified form partially by the dashed lines in FIG. 1, is provided in the cylinder head 14.

The cooling duct system 20 is fed by inflows and outflows in the cylinder block 12, with only one inflow 22 being illustrated in FIG. 1.

Figure 2:
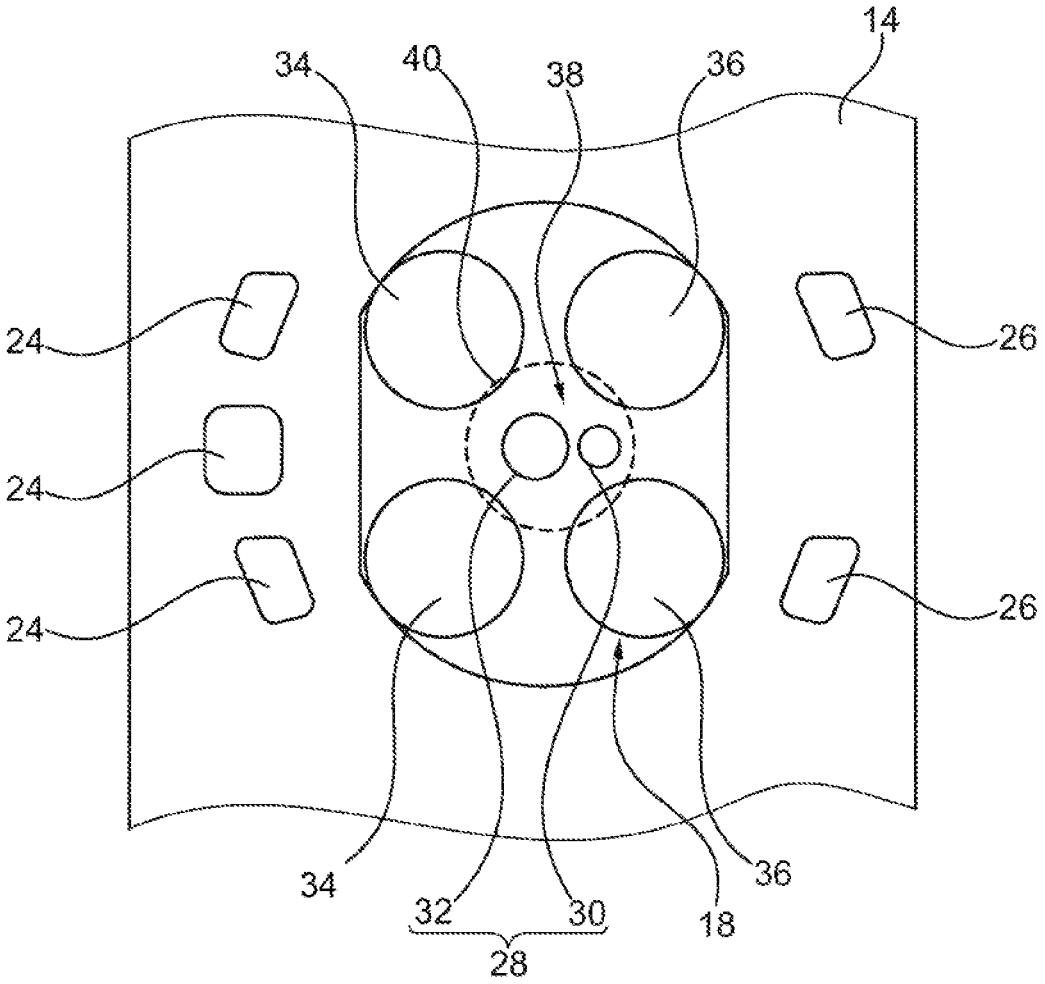
FIG. 2 shows a schematic bottom view of the cylinder head according to FIG. 1.

As can be seen in FIG. 2, the cylinder head 14, more precisely the cooling duct system 20, has three inlets 24 and two outlets 26 for coolant. Accordingly, a coolant-inlet side and a coolant-outlet side can be determined in the cylinder head 14. In FIG. 2, the left side is the coolant-inlet side and the right side is the coolant-outlet side.

The cylinder block 12 has two component openings 28, for example an injection nozzle opening 30 and a spark plug opening 32 which lead into the combustion chamber section 18 and through which components, such as an injection nozzle or a spark plug, can be guided.

The component openings 28 are adjacent in the direction of flow, and therefore one of the component openings 28 is provided closer to the coolant-inlet side than the other.

In the embodiment shown, the coolant-inlet-side component opening 28 is the spark plug opening 32 and the injection nozzle opening 30 is the coolant-outlet side.

In addition, two coolant-inlet-side gas ducts 34 and two coolant-outlet-side gas ducts 36 lead into the combustion chamber section 18. The four gas ducts 34, 36 serve to supply air to the combustion chamber 16 or to remove combustion exhaust gases from the combustion chamber 16. For clarity reasons, the illustration of the gas ducts 34, 36 has been omitted in FIG. 1.

Of course, a different number of gas ducts 34, 36 can also be provided.

In the embodiment shown, the coolant-inlet-side gas ducts 34 are the air outlets and the coolant-outlet-side gas ducts 36 are the air inlets to the combustion chamber 16.

That region of the cylinder head 14 which is adjacent to the combustion chamber 16 between the gas ducts 34, 36 is referred to as web 38. The component openings 28 also extend through the web 38.

In the region of the web 38, an annular wall section 40 is provided in the cylinder head 14 between the component openings 28, on the one hand, and the gas ducts 34, 36, on the other hand.

The annular wall section 40 has a center axis M which extends approximately between the two component openings 28 and which divides the annular wall section 40 into a coolant-inlet-side half and a coolant-outlet-side half.

The cooling duct system 20 extends through the entire cylinder head 14 and, in the embodiment shown, has a web cooling duct 42, two outer cooling ducts 44 and an upper cooling duct 45.

Figure 3:
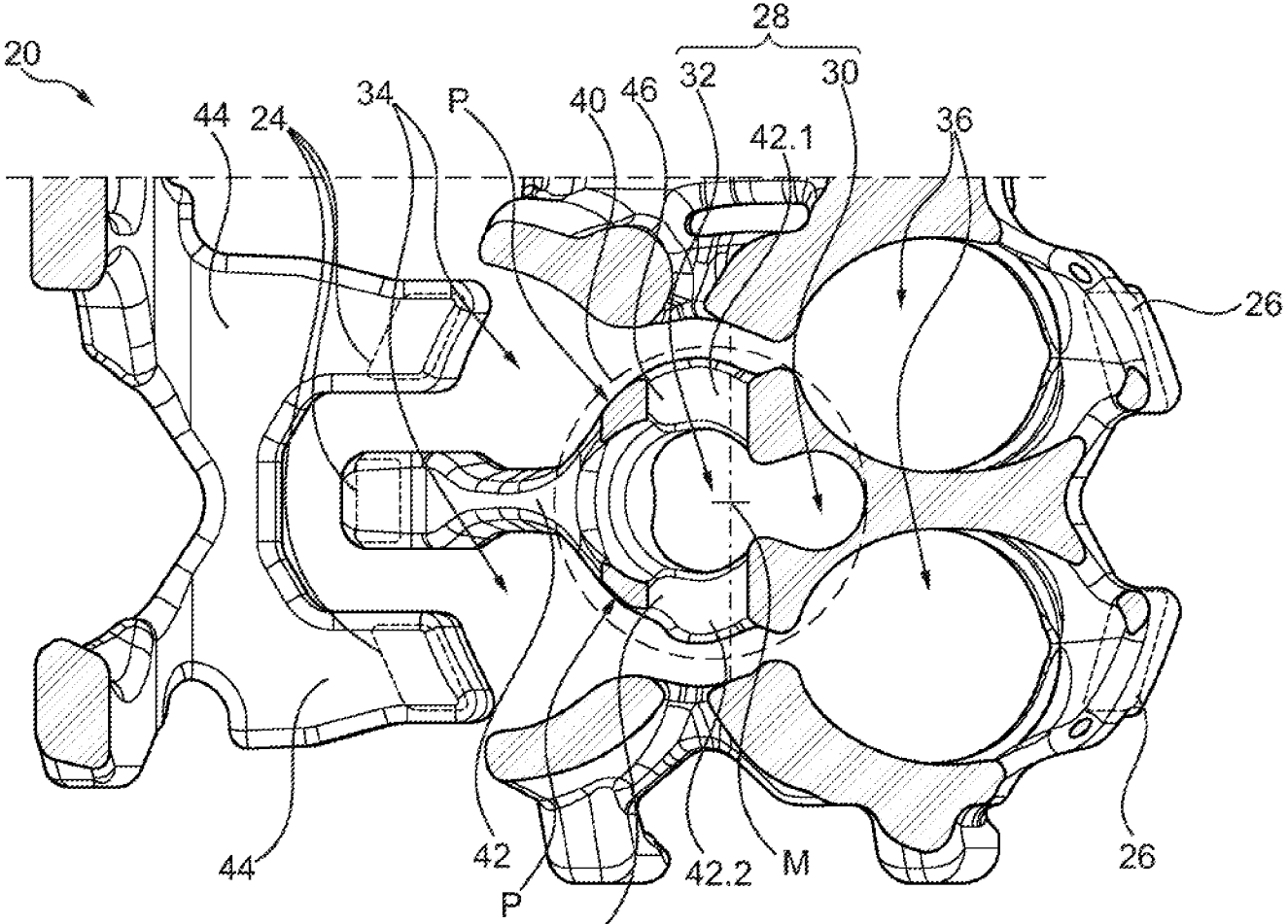
FIG. 3 shows a sectional view of the cooling duct system of the cylinder head according to FIG. 1 from above.

As illustrated in FIG. 3, the two outer cooling ducts 44 begin at the two outer of the three inlets 24, first of all extend away from the annular wall section 40 and then rise to above the coolant-inlet-side gas ducts 34.

Figure 4:
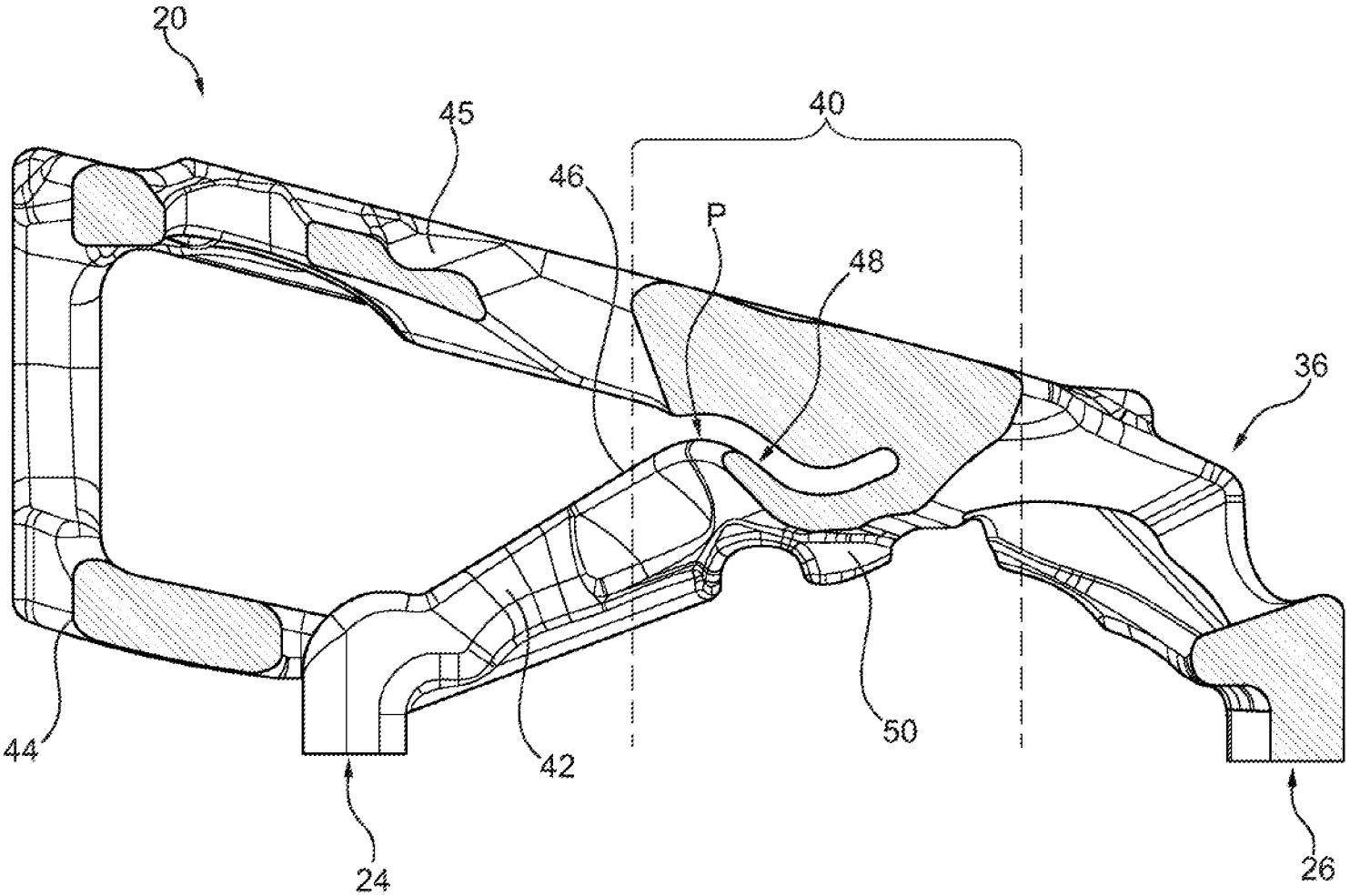
FIG. 4 shows a lateral side view of the cooling duct system from FIG. 3.

The outer cooling ducts 44 converge above the coolant-inlet-side gas ducts 34 and form the upper cooling duct 45 which drops continuously down toward the coolant-outlet side (see FIG. 4).

The web cooling duct 42 extends from the middle of the three inlets 24 into the annular wall section 40. It can run here between the coolant-inlet-side gas ducts 34.

The web cooling duct 42 is fluidically separated here from the outer cooling ducts 44 and the upper cooling duct 45 in the region on the coolant-inlet side of the annular wall section 40.

Inside the annular wall section 40, but on the coolant-inlet side of the component openings 28, the web cooling duct branches into two branches 42.1 and 42.2 which encircle the component openings 28 on different sides.

The course of just one branch 42.1, 42.2 of the web cooling duct 42 will be described below since the two branches 42.1, 42.2 are mirror-symmetrical.

Figure 5:
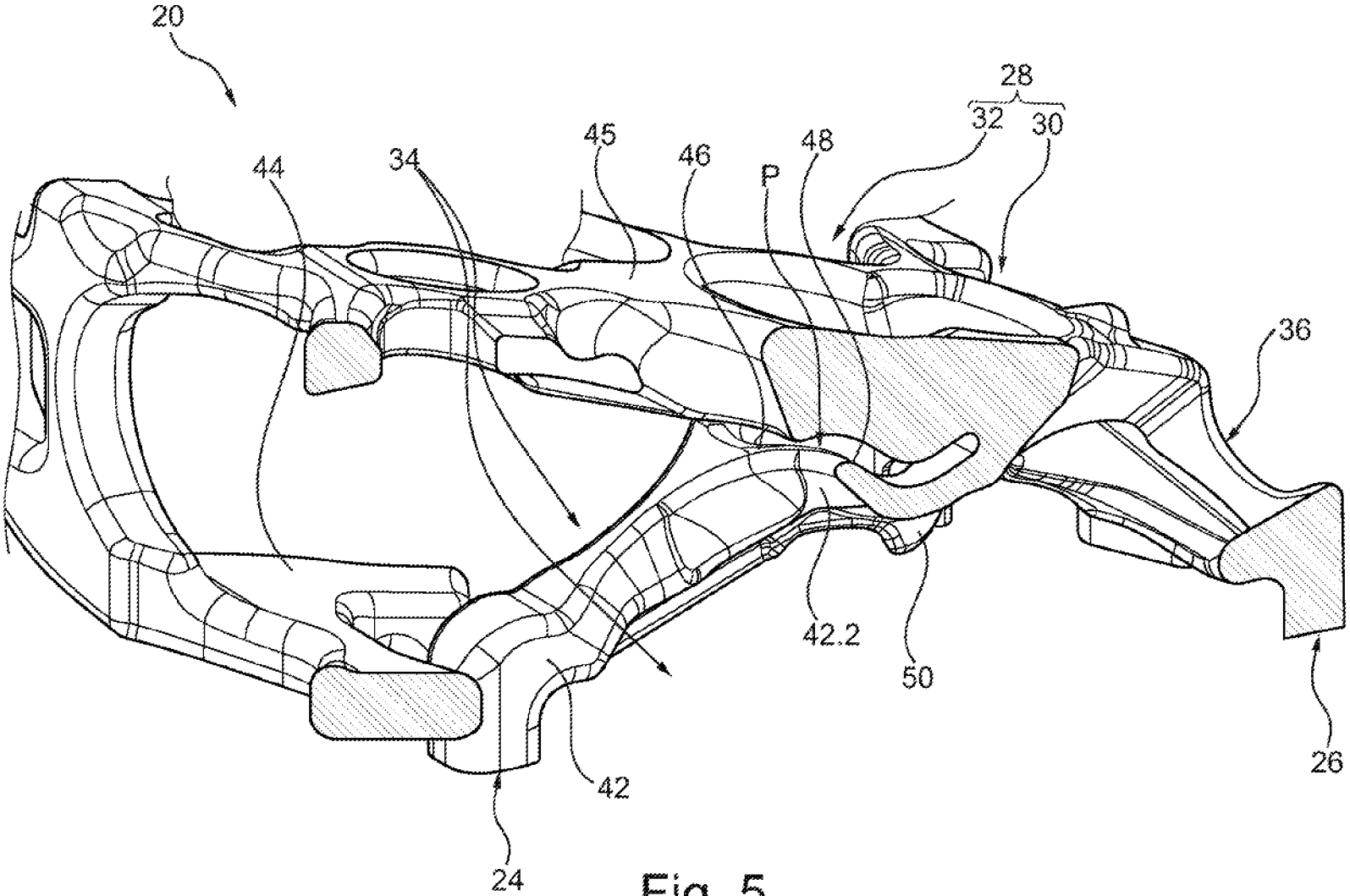
FIG. 5 shows a perspective sectional view of the cooling duct system according to FIG. 3.

As can be seen in FIGS. 4 and 5, the web cooling duct 42 has an upper wall 46 which substantially determines the flow of the coolant inside the web cooling duct 42.

The upper wall 46 reaches its highest point P before the center axis M of the annular wall section 40 and then drops down toward the coolant-outlet side.

The upper wall 46 describes a wave shape with a wave crest in the region of its highest point P.

The dropping part of the upper wall 46, which part adjoins the highest point P on the coolant-outlet side, is designed as a guiding surface 48 which is directed obliquely downward, i.e. to the combustion chamber section 18. The guiding surface 48 is located within the annular wall section 40.

Adjoining the region of the guiding surface 48 to the coolant-outlet side, the web cooling duct 42 has an extension 50 which projects toward the combustion chamber section 18.

The extension 50 is also provided in the annular wall section 40 and can reach up to 9 mm or less to the combustion chamber section 18, and therefore there is a distance of 9 mm between the lower wall of the web cooling duct 42 in the region of the extension 50 toward the combustion chamber section 18.

It is also contemplated for the extension 50 to be arranged in the region of the guiding surface 48 itself.

Adjoining the region of the extension 50 or, as in the embodiment shown, in the region of the extension 50, the web cooling duct 42 leads into the upper cooling duct 45.

The mouth is located here in the coolant-outlet-side half of the annular wall section 40.

The upper wall 46 of the web cooling duct 42 and also the entire web cooling duct 42 rise again here toward the mouth of the web cooling duct 42.

The upper wall 46 therefore also has a wave trough which lies in the region of the extension 50.

On the coolant-outlet side of the mouth of the web cooling duct 42, the upper cooling duct 45 at least partially runs between the coolant-outlet-side gas ducts 36 and leads into the two outlets 26.

Coolant which flows through the middle of the inlets 24 into the web cooling duct 42 flows through the web cooling duct 42 as far as the highest point P and is deflected there by the guiding surface 48 in the direction toward the combustion chamber section 18.

A particularly effective flow toward the web 38 is thereby achieved here, in particular by means of the flow through the extension 50. The temperature of the web 38 during the operation of the internal combustion engine 10 can thereby be significantly reduced.

In the description of the cooling duct system 20, only the two outer cooling ducts 44, the web cooling duct 42 and the upper cooling duct 45 of a cylinder have been discussed. Of course, in an internal combustion engine 10 having a plurality of cylinders, a plurality of said assemblies consisting of outer cooling ducts 44, web cooling duct 42 and upper cooling duct 45 are provided, with it being possible for the upper cooling ducts 45 of adjacent cylinders to be fluidically connected to one another.

Of course, the cooling duct system 20 can have yet further cooling ducts which, for clarity reasons, have not been shown in the figures and explained. In particular, it is contemplated for further inlets and outlets of the cooling duct system 20 to be provided in the cylinder head 14.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A cylinder head for an internal combustion engine having at least one cylinder, comprising:

a cooling duct system which has a coolant-inlet side and a coolant-outlet side, a combustion chamber section, two coolant-inlet-side gas ducts, two coolant-outlet-side gas ducts, and two adjacent component openings, wherein the coolant-inlet-side gas ducts, the coolant-outlet-side gas ducts and the component openings all lead into the combustion chamber section, the cylinder head has an annular wall section which is provided between the component openings, on the one hand, and the gas ducts, on the other hand, the cooling duct system has a web cooling duct which runs into the annular wall section, extends between the coolant-inlet-side gas ducts and has an upper wall, the upper wall has a guiding surface at a highest point of the upper wall, the guiding surface being directed obliquely downward in a region of the annular wall section, in order to deflect coolant in the direction of the combustion chamber section, the cooling duct system has at least one outer cooling duct which runs to above one of the two coolant-inlet-side gas ducts and forms an upper cooling duct, in the half of the annular wall section which faces coolant-outlet-side ducts, the web cooling duct leads into the upper cooling duct, and the upper wall rises again before the web cooling duct leads into the upper cooling duct.

2. The cylinder head as claimed in claim 1, wherein the web cooling duct rises between the coolant-inlet-side gas ducts.

3. The cylinder head as claimed in claim 1, wherein the upper wall rises between the coolant-inlet-side gas ducts, reaches its highest point on the coolant-inlet side before a center axis of the annular wall section, and drops down toward the coolant-outlet side.

4. The cylinder head as claimed in claim 1, wherein the upper wall is partially wave-shaped with at least one wave crest.

5. The cylinder head as claimed in claim 1, wherein the web cooling duct has an extension which projects toward the combustion chamber section and is provided in the region of the annular wall section.

6. The cylinder head as claimed in claim 5, wherein the extension is provided in the region of the guiding surface or adjoining the region of the guiding surface on the coolant-outlet side.

7. The cylinder head as claimed in claim 5, wherein the upper wall of the web cooling duct has a wave trough in the region of the extension.

8. The cylinder head as claimed in claim 5, wherein the extension reaches up to 9 mm or less to the combustion chamber section.

9. The cylinder head as claimed in claim 1, wherein the web cooling duct is separated from the at least one outer cooling duct and the upper cooling duct on the coolant-inlet side of the annular wall section.

10. The cylinder head as claimed in claim 1, wherein on the coolant-inlet side of the two component openings, the web cooling duct branches into two branches which extend on different sides of the component openings.

11. The cylinder head as claimed in claim 10, wherein another guiding surface and/or an extension are provided in each of the two branches.

12. The cylinder head as claimed in claim 10, wherein two outer cooling ducts are provided which flow together above the coolant-inlet-side gas ducts and form the upper cooling duct.

13. The cylinder head as claimed in claim 12, wherein the upper cooling duct runs between the coolant-outlet-side gas ducts.

14. The cylinder head as claimed in claim 1, wherein the two adjacent component openings comprise a spark plug opening and an injection nozzle opening.

15. The cylinder head as claimed in claim 1, wherein the web cooling duct leads into the upper cooling duct in a region of the coolant-outlet side of the two component openings.

16. The cylinder head as claimed in claim 1, wherein the entire web cooling duct rises again before the web cooling duct leads into the upper cooling duct.

* * * * *